US007458449B2

(12) United States Patent
Sennhauser

(10) Patent No.: US 7,458,449 B2
(45) Date of Patent: Dec. 2, 2008

(54) SHOCK ABSORBING DEVICE FOR A CABLE UNDER TENSION, IN PARTICULAR FOR ROCKFALL, DEBRIS FLOW AND AVALANCHE CONTROL WORKS

(75) Inventor: Marcel Sennhauser, Frasnacht/TG (CH)

(73) Assignee: FATZER AG, Romanshorn (CH)

( * ) Notice: Subject to any disclaimer, the term of this patent is extended or adjusted under 35 U.S.C. 154(b) by 0 days.

(21) Appl. No.: 11/818,527

(22) Filed: Jun. 14, 2007

(65) Prior Publication Data

US 2008/0006757 A1 Jan. 10, 2008

(30) Foreign Application Priority Data

Jun. 17, 2006 (CH) ..... 0987/06

(51) Int. Cl.
*B64F 1/02* (2006.01)

(52) U.S. Cl. ..... 188/372; 248/74.1; 248/74.2

(58) Field of Classification Search ..... 267/148, 267/149, 152; 188/372; 248/63, 68.1, 74.1, 248/74.4; 174/64, 68.1, 92, 135
See application file for complete search history.

(56) References Cited

U.S. PATENT DOCUMENTS 4,095,328 A * 6/1978 Cawthorne ..... 29/515
4,612,680 A * 9/1986 Daiguji ..... 14/22
5,207,302 A * 5/1993 Popp et al. ..... 188/372
5,794,897 A * 8/1998 Jobin et al. ..... 248/74.4
6,079,673 A * 6/2000 Cox ..... 248/63
6,131,873 A * 10/2000 Blazon et al. ..... 248/548
6,386,526 B1 * 5/2002 Sarkar et al. ..... 267/136

* cited by examiner

*Primary Examiner*—Christopher P Schwartz
(74) *Attorney, Agent, or Firm*—Brian Roffe

(57) ABSTRACT

A shock absorbing device for a cable under tension, in particular for rockfall, debris flow and avalanche control works, is equipped with an elongate, helical deformation element (1), through which the cable (9) can be looped. Both overlapping end areas (2, 3) of the deformation element (1) are guided through a holding element (10; 30), and the deformation element (1) is plastically deformable when the cable is overloaded, by reducing the helical diameter. The holding element (10; 30) has bevels or roundings (21, 22, 23; 40, 41) at the entry and exit of an opening (31) formed for the overlapping end sections (2, 3) of the deformation element (1). The effect of this is that the reduction of the helical diameter can progress more consistently than before, and also the load-damping curve can be defined better.

20 Claims, 2 Drawing Sheets

Fig.5
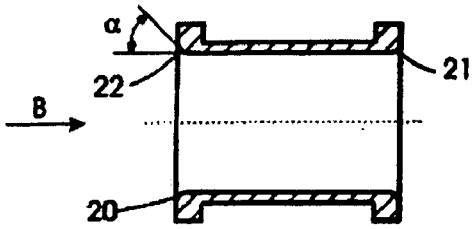
Fig.6
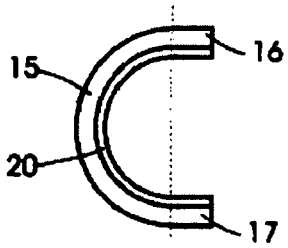
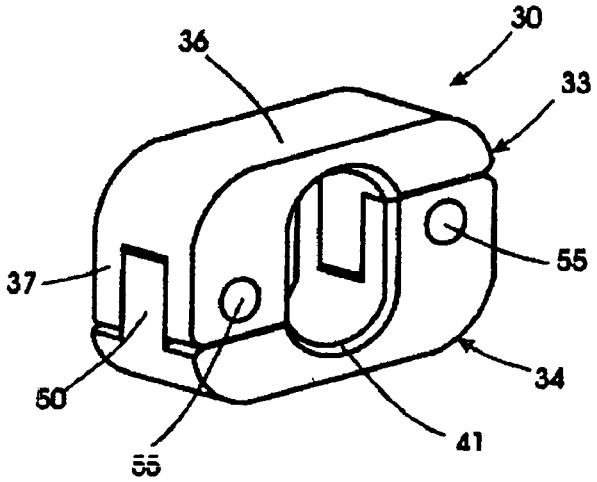
Fig.7
Fig.8
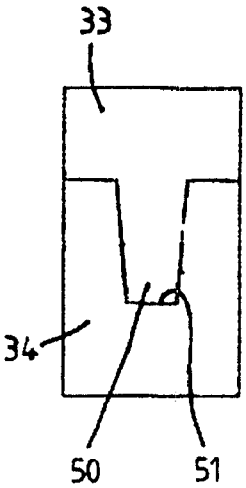
Fig.9
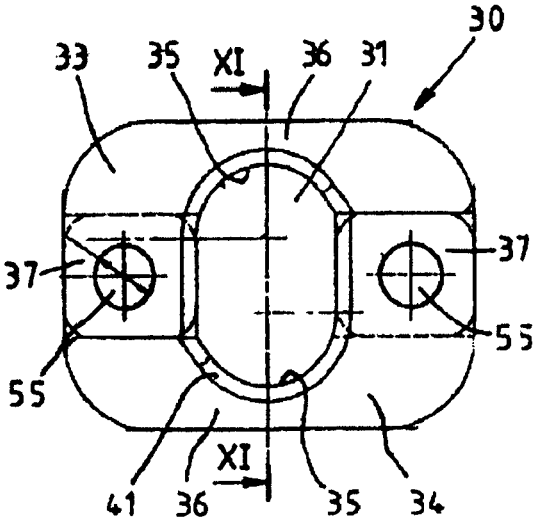
Fig.10
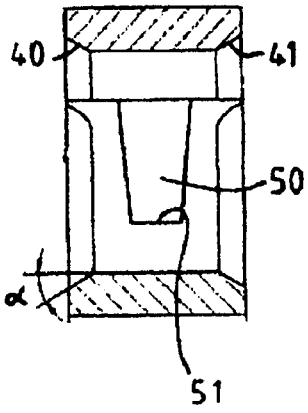

SHOCK ABSORBING DEVICE FOR A CABLE UNDER TENSION, IN PARTICULAR FOR ROCKFALL, DEBRIS FLOW AND AVALANCHE CONTROL WORKS

The present invention relates to a shock absorbing device for a cable under tension, in particular for rockfall and avalanche control works, according to the preamble of claim 1.

A device of this type is disclosed in EP-B-0 494 046. The cable is looped through a helical deformation element in the form of a tube and the overlapping tube ends are guided through a clamping element, while the tube is plastically deformed when the cable is overloaded, as the helical diameter is reduced. The clamping element is in the form of a compression sleeve. A frictional engagement arises between the tube and the clamping element which can only be overcome after an initial tension force has been exceeded. The damping curve rises in approximately linear fashion over the area of the cable extension, as the result of which a progressive absorption of the kinetic energy, for example from a rockfall, occurs.

The present invention is based on the problem of making a decisive further improvement to the device of the first-mentioned type with respect to the load-damping curve.

This problem is solved according to the invention by a device with the features of claim 1.

Further preferred embodiments of the device according to the invention form the subject matter of the dependent claims.

Since according to the invention the holding element has bevels, roundings and soft inlays or special surface coatings at the entry and exit of an opening formed for the overlapping ends of the deformation element, the plastic deformation of the deformation element which occurs when the cable is overloaded, as the helical diameter reduces, can progress more consistently than before, and also the load-damping curve is better defined, while the effect (damping) sets in more rapidly, i.e. greater resistance is generated right from the start, which catches any shock loading, for example due to large falling rocks.

The damping curve can be largely predetermined, not only by the dimensioning of the helical deformation element, but also by the choice of material and geometrical design of the holding element. The holding element can advantageously include a bearing shell enclosed by a compression sleeve as a transition piece, where the compression sleeve can preferably be made of aluminum and the bearing shell with bevels or roundings can be made of corrosion-resistant steel or of steel with a corrosion-resistant layer or coating. For technical production reasons, it is also advantageous to have a two-part holding element according to the invention made from corrosion-resistant steel.

The invention will next be explained in more detail with the aid of the drawings, which show:

FIG. 5 shows the bearing shell part according to FIG. 4 in lateral view;

FIG. 6 shows the bearing shell part in the direction of arrow B according to FIG. 5;

FIG. 7 shows a further embodiment of a holding element for an inventive shock absorption device for a cable under tension in perspective view;

FIG. 8 shows the holding element according to FIG. 7 in frontal view;

FIG. 9 shows the holding element according to FIG. 7 in lateral view; and FIG. 10 is a section along line XI-XI in FIG. 9.

Figure 1:
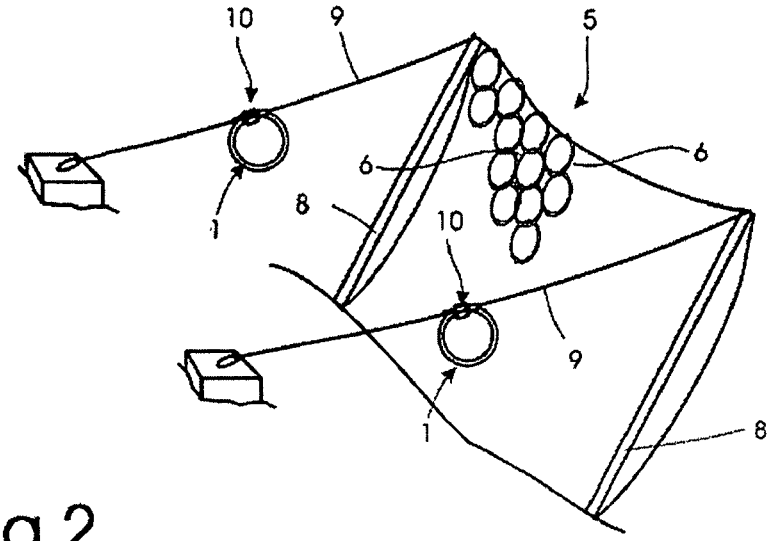
FIG. 1 is a diagrammatical view of a safety net with inventive shock absorption devices for a cable under tension.

FIG. 1 shows a diagrammatical view of a safety net 5 which is used in particular for rockfall and snow barriers, and to this end for example is installed on a slope and ensures that falling rocks, timber, debris, glacial deposits or the like, or snow avalanches, are securely caught. This safety net 5 consists for example of ordinary interconnected ring elements 6, a few of which are shown. This safety net 5 is hereby held, via bearer cables 7, by corresponding stays 8 anchored in the ground, which in turn are secured by retaining cables 9. The retaining cables 9 are each equipped in the present case with an inventive device for shock absorption purposes in the event of a boulder or similar falling in. It would, however, also be possible to provide several such devices for each retaining cable.

Figure 2:
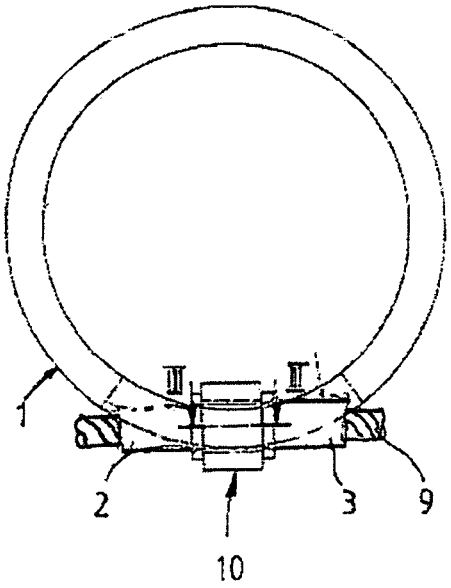
FIG. 2 shows the device from FIG. 1 in frontal view.
Figure 3:
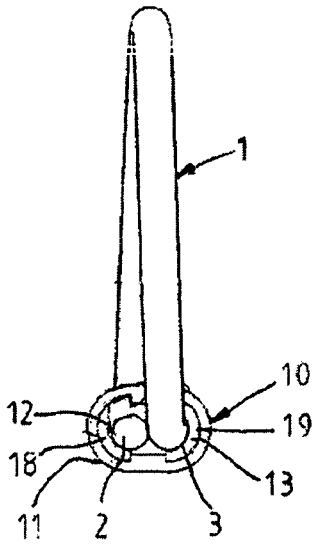
FIG. 3 shows the device from FIG. 2 in lateral view.

FIG. 2 shows this shock-absorbing device for the cable 9 tensioned by the event. The conventional steel cable 9 is looped through an elongate, helical deformation element 1, preferably a tube, the two overlapping end sections 2, 3 of which are guided through a holding element 10 and held together thereby. The cable diameter is less than the inner diameter of the tube, so that the cable is easy to pull in.

When the cable 9 is overloaded, for example by falling masses of stones or snow, the helical diameter is reduced, while the deformation element 1 is pulled through the holding element 10, at least on one side. Due to this plastic deformation of the deformation element 1 and due to the friction between the deformation element 1 and the holding element 10, any high-impact load acting on the cable 9 is damped and kinetic energy is progressively reduced as the extension of the cable increases, in which case the cable strength can be exploited to the full. With relatively long cables, several such helixes can be distributed over the cable length. Several helixes can also be guided through the holding element.

In the embodiment shown in FIG. 2 to FIG. 7, the holding element 10—similarly to the device in EP-B-0 494 046—includes a compression sleeve 11, preferably made of aluminum (cf. in particular FIG. 4), which here, however, does not act directly on the two overlapping end sections 2, 3 of the deformation element 1 to hold or press them together, but encloses a bearing shell accepting the end sections 2, 3. The bearing shell is preferably made from corrosion-resistant steel or of steel with a corrosion-resistant layer or coating. The bearing shell is preferably designed in two parts, each bearing shell part 12, 13 partly surrounding one end section 2, 3.

Figure 4:
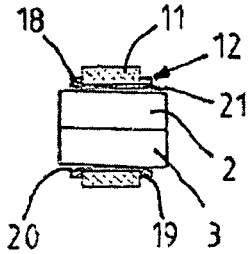
FIG. 4 is a section along line III-III in FIG. 2.

As can be seen from FIG. 4 to FIG. 6, which show one of the bearing shell parts, the bearing shell parts 12, 13 each have a semi-circular part 15 corresponding to the tube diameter and straight parts 16, 17 projecting out from the latter. The width of the bearing shell parts 12, 13 is greater than the width of the compression sleeve 11 (cf. in particular FIG. 4), and the bearing shell parts 12, 13 have flange parts 18, 19 between which the compression sleeve 11 engages. The two bearing shell parts 12, 13 are then pressed together with their straight parts 16, 17 and thus the end sections 2, 3 are also pressed together via the semicircular shell parts 15.

According to the invention, the holding element 10 has bevels or roundings on the entry and exit of the opening formed for the overlapping end sections 2, 3 of the deformation element 1, which promote the deformation process associated with the change in the helical diameter, so that this can occur more consistently and with better definition. FIG. 4 to FIG. 6 show bevels or roundings 20, 21 on the entry and exit which enclose an angle $\alpha$ of, for example, 45° with the longitudinal axis of the holding element opening, and roundings 22 are also indicated. Both the semicircular part 15 and the straight parts 16, 17 are equipped with bevels or roundings. It is, however, also possible to achieve the inventive effect by corresponding inlays in the arrival area of the deformation element 1. Various softer materials could be used for this, which can be laid into the roundings or bevels.

Another embodiment of an advantageous holding element 30 is shown in FIGS. 7 to 10. The holding element 30 includes two clamping elements 33, 34 which can be joined, together forming an opening 31 for the overlapping end sections 2, 3 of the deformation element 1. The clamping or holding elements can also have a different design, in which case the connection between the two clamping or holding elements can also be realised using screws, bolts or similar connection means. Each clamping element 33, 34 has a cross-part 36 provided with a semi-circular recess 35 corresponding to the cross section of the tube and two straight side parts 37 attached to the cross part 36. At the entry and exit to the opening 31, in turn, the inventive bevels 40, 41 are arranged, which are produced both on the respective cross part 36 and on side parts 37.

In an especially advantageous fashion, both clamping elements 33, 34 of the holding element 30 are identical in structure, in which case the one side part 37 includes a projection 50 oriented transversely to the opening axis and the other side part 37 is in the form of a fork and is provided with a groove 51 oriented transversely to the opening axis. The two clamping parts 33, 34—reciprocally rotated through 180°—can be brought together in such a way that the one clamping part 33 projects with the projection 50 into the groove 51 of the other clamping element 33 and its groove 51 accepts the projection 50 of the other clamping element 34. The clamping parts 33, 34 interlocking with each other in this way are joined via a compression bolt 55 guided through the fork-shaped side parts and the projections 50 inserted therein, and hence the end sections 2, 3 are locked.

Advantageously both the projection 50 and the grooves 51 are wedge-shaped in cross section.

The clamping elements 33, 34 are preferably made of corrosion-resistant steel or of steel with a corrosion-resistant layer or coating.

After joining, the clamping parts 33, 34 act so as to be "self-locking", since the deformation element applies the necessary counterpressure.

Instead of a tube, an elongate deformation element which is not completely closed around its circumference could also be used to receive the cable. In particular, deformation elements with U and L profiles or similar profiles could be used for this.

In the inventive devices, the load-damping curve can be pre-defined, not only, as previously, by the dimensioning of the helically shaped deformation element and in any event by the generation of a frictional engagement between the deformation element and the holding element, but it can also be defined more clearly by the geometric design of the holding element and the selection of material.

In original condition, this holding element can enclose this deformation element with little play or else clamp or compress the deformation element by acting as a clamping element.

The invention claimed is:

1. Shock absorbing device for a stretched cable including an elongate deformation element in the form of a helix through which the cable can be passed, and a holding element, the deformation element having two overlapping end sections which are guided through the holding element and, when the cable is overloaded, the deformation element is plastically deformable by reducing the diameter of the helix, wherein the holding element has an opening through which the overlapping end sections pass, and bevels at both ends of the opening, each of the bevels being arranged to enclose an angle with a longitudinal axis of the opening.

2. Device according to claim 1, wherein the holding element includes a bearing shell, the bevels being built onto the bearing shell, and a compression sleeve surrounding the bearing shell.

3. Device according to claim 2, wherein the bearing shell is designed in two parts, each bearing shell part partly surrounding a respective one of the end sections of the deformation element.

4. Device according to claim 3, wherein a width of the bearing shell parts is greater than a width of the compression sleeve, while the bevels are each assigned to a flange part of the respective bearing shell part and between which flange parts the compression sleeve engages.

5. Device according to claim 4, wherein the two bearing shell parts are designed to accept end sections of a tubular deformation element and each has a semi-circular part corresponding to the tube diameter and straight cross-parts projecting from the semi-circular part, the bevels being arranged on both the semi-circular parts and the straight cross-parts.

6. Device according to claim 2, wherein the bearing shell comprises first and second bearing shell parts.

7. Device according to claim 1, wherein the holding element includes two clamping parts which can be joined together, which together form the opening for the overlapping end sections of the deformation element, the bevels being arranged on both clamping parts.

8. Device according to claim 7, wherein the opening is provided to accept the end sections of a tubular deformation element and the clamping parts which form the opening each have a cross-parts provided with a semi-circular recess corresponding to the cross section of the tube and two straight side parts attached to the cross parts, the bevels being arranged on both the cross parts and the side parts.

9. Device according to claim 8, wherein the clamping parts forming the opening are identical in design, one side part includes a projection oriented transversely to the opening axis and the other side part is in the form of a fork and is provided with a groove oriented transversely to the opening axis, such that the two clamping parts, when reciprocally rotated through 180°, can be brought together in such a way that one clamping part projects with the projection into the groove of the other clamping part and its groove accepts the projection of the other clamping part, the holding element further including a compression bolt guided through the fork-shaped side parts and the projections inserted therein to thereby join the assembled clamping parts.

10. Device according to claim 9, wherein the projections and the grooves have a wedge-shaped cross section.

11. Device according to claim 7, wherein both clamping parts are made from corrosion-resistant steel or from steel with a corrosion-resistant layer or coating.

12. Device according to claim 2, wherein the compression sleeve is made from aluminum and the bearing shells and bearing shell parts are made from corrosion-resistant steel or from steel with a corrosion-resistant layer or coating.

13. Device according to claim 1, wherein the bearing shell is made from the same material and/or with the same surface coating as the deformation element.

14. Device according to claim 1, wherein the clamping parts are designed to be self-locking once assembled.

15. Device according to claim 1, wherein the holding element comprises first and second bearing shell parts wherein define the opening therebetween, the first bearing shell part surrounding a first one of the overlapping end sections and the second bearing shell part surrounding a second one of the overlapping end sections, each of the first and second bearing shell parts having a semi-circular part corresponding to a diameter of the respective one of the overlapping end sections and straight parts projecting from the semi-circular part, the bevels being formed on the semi-circular part and the straight parts at both ends of the opening.

16. Device according to claim 1, wherein the holding element comprises first and second clamping elements which define the opening therebetween, the first clamping element partly surrounding a first one of the overlapping end sections and the second clamping element partly surrounding a second one of the overlapping end sections, each of the first and second clamping elements having a cross-part defining a semi-circular recess corresponding to a cross-section of the respective one of the overlapping end sections and straight side parts attached to the cross-part, the bevels being formed on the cross-part and the straight side parts at both ends of the opening.

17. Device according to claim 1, wherein the angle between each of the bevels and the longitudinal axis of the opening is 45°.

18. Device according to claim 1, wherein the bevels are flat.

19. Device according to claim 1, wherein the bevels are rounded.

20. Device according to claim 1, wherein the bevels are arranged completely round both ends of the opening.

* * * * *

UNITED STATES PATENT AND TRADEMARK OFFICE

CERTIFICATE OF CORRECTION

PATENT NO. : 7,458,449 B2
APPLICATION NO. : 11/818527
DATED : December 2, 2008
INVENTOR(S) : Marcel Sennhauser It is certified that error appears in the above-identified patent and that said Letters Patent is hereby corrected as shown below:

Column 6, line 13, replace “round” with --around--.

Signed and Sealed this

Twentieth Day of January, 2009

JON W. DUDAS
*Director of the United States Patent and Trademark Office*